US007827831B2

(12) United States Patent
Bolduan et al.

(10) Patent No.: US 7,827,831 B2
(45) Date of Patent: Nov. 9, 2010

(54) DETERGENT FLUSH-IN DEVICE

(75) Inventors: Edwin Bolduan, Berlin (DE); Alexander Schlitzer, Berlin (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 916 days.

(21) Appl. No.: 11/282,817

(22) Filed: Nov. 17, 2005

(65) Prior Publication Data

US 2006/0130536 A1 Jun. 22, 2006

(30) Foreign Application Priority Data

Dec. 20, 2004 (DE) ..... 10 2004 061 306

(51) Int. Cl.
*D06F 29/00* (2006.01)
*D06F 35/00* (2006.01)

(52) U.S. Cl. ..... 68/17 R

(58) Field of Classification Search ..... 68/17 R
See application file for complete search history.

(56) References Cited

U.S. PATENT DOCUMENTS 3,974,667 A * 8/1976 Gakhar ..... 68/17 R
4,160,367 A * 7/1979 Vona, Jr. ..... 68/17 R

FOREIGN PATENT DOCUMENTS

DE 69 01 706 U 1/1969
EP 0 982 426 5/2003
WO WO 03057970 A1 * 7/2003

OTHER PUBLICATIONS

Machine Translation of Proppe. FR 2512854, Mar. 1983.*
German Search Report for 10 2004 061 306.0, (Jul. 2005).

* cited by examiner

*Primary Examiner*—Frankie L Stinson
*Assistant Examiner*—David Cormier
(74) *Attorney, Agent, or Firm*—James E. Howard; Andre Pallapies

(57) ABSTRACT

A flush-in device is provided for a washing machine and has at least one flushable chamber open at the top. In order that, during flushing, liquid does not easily enter into an outer area of the flush-in device as a result, for example, of leakage and/or water of condensation and in order to simplify the construction of the flush-in device, especially in a sealing area and to reduce assembly expenditure, at least one annular channel at least partially surrounding the upper opening of the flushable chamber is provided and any liquid which has already penetrated into the annular channel can be led away via this channel.

15 Claims, 3 Drawing Sheets

DETERGENT FLUSH-IN DEVICE

Figure 1:
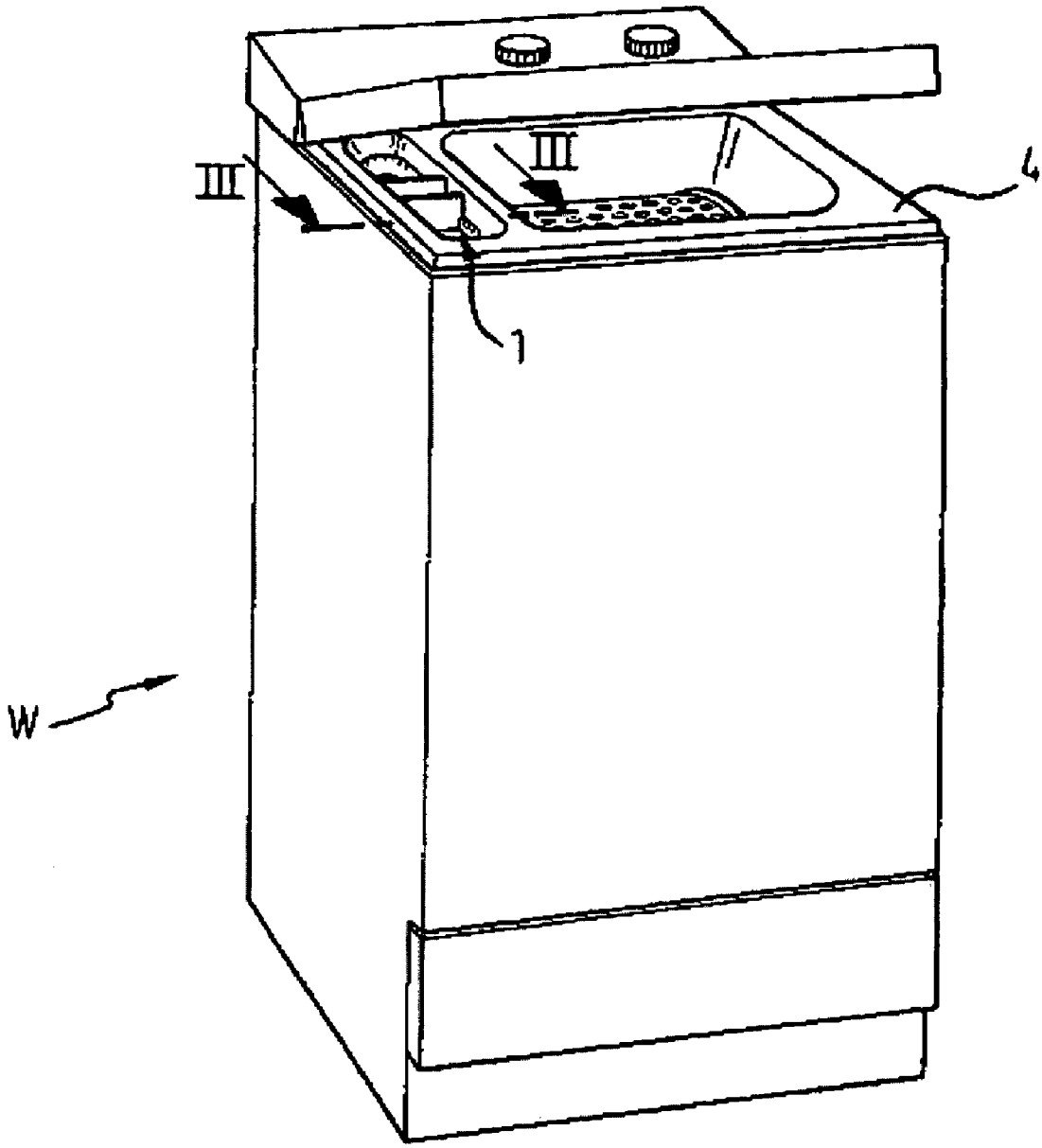

The invention relates to a flush-in device, especially for flushing detergent into a washing machine, comprising at least one flushable container open at the top, a flush-in device with an additional cover screen and a washing machine with a flush-in device according to the invention.

Known from DE 67 50 750 U is a detergent flush-in vessel where a circumferential sealing element is required for sealing between a container wall and a cover skirt, which prevents any escape of water into the surroundings of the device.

Known from DE 31 36 768 A1 for example, is a device for the fanned-out supply of water into a container open at the top where a seal between a flush-in device and the relevant cover frame manages without special sealing elements. The device from DE 31 36 768 A1 is characterised in that a pipe orifice, as an integral part of a semicircular wall, is surrounded by a slot-shaped cavity and a skirt is connected in one piece to a cover frame which closes off the cavity at the top and which, in the region outside the cavity, has a fitting frame bearing on the inside against the wall set back outwards in this region and guided at a distance from the skirt, and in the cavity, a centring shell which extends along the fitting frame, and in that the cavity extends beyond the skirt downwards.

The known devices have the disadvantage that they require comparatively expensive seals, whether this be by means of a special sealing element or by a complex configuration of the water supply or the sealing area.

The object of the present invention is to ensure an increased safety from liquid entering into the outer area of the flush-in device, for example, leakage and/or water of condensation. A further object is to simplify a design of the flush-in device, especially in the sealing area. It is also an object to provide a possibility for reducing assembly expenditure. A further object is to possibly optimise the space between flush-in device and a cover screen.

These objects are solved by a flush-in device comprising at least one flushable chamber open at the top being characterised in that an annular channel at least partially surrounding the upper opening of the flushable chamber is provided, and a liquid located in the annular channel can be led away. By this means, liquid escaping from the flushable chamber in the direction of the annular channel can be intercepted and returned to the flushable chamber. This is the case, for example, with leakage liquid which escapes laterally at the edge of the flushable chamber, for example, through a sealing area.

The flush-in device is especially suitable for use in appliances which clean with the aid of liquid(s), that is for example, in a washing machine or a dishwasher. In this case, the liquid is typically water which is enriched with dissolved and/or still undissolved cleansing agents as required.

The sealing area can be located, for example, between the flush-in device and a cover screen which can be placed thereon, but also relates to sealing areas between several parts of the flush-in device if this is executed as multi-component.

The annular channel can be both at least partly circumferential and also completely circumferential as required. If there is more than one flushable chamber, it can be advantageous, for example, if the annular channel surrounds all the flushable containers, at least in part. The annular channel can also be sloping for faster removal of liquid.

The annular channel results in increased safety from liquid entering into the outer area of the flushing device since this is intercepted in the annular channel and led away. This can comprise both leakage fluid and, for example, water of condensation which condenses under a screen. As a result of the intercepting function of the annular channel, the design of the flush-in device can be simplified, especially in the sealing area since no expensive seal, e.g. as a result of using special sealing elements, is required and/or a simpler design of the sealing area can be achieved. This also results in a reduction in the assembly expenditure. As a result of the potentially simple shape of the sealing area, the flush-in device can be made comparatively compact, especially low. This results in an optimisation of the space between flush-in device and a cover screen.

For the case where a cover screen can be placed on the flush-in device it is advantageous if this is placed so that a sealing zone can be produced between flush-in device and cover screen, wherein the sealing zone surrounds the at least one flushable chamber at least partly circumferentially and the annular channel is located at least partly on the side of the sealing zone facing away from the flushable chamber. In particular it is favourable if the entire sealing zone is protected against leakage by the annular channel. The sealing zone can be produced, for example, by means of a plug connection and/or by other measures such as slipping on, locating, gluing or welding.

It is favourable if the annular channel has at least one diverting opening designed for diverting, especially a bore hole, to the at least one flushable chamber. It is especially favourable if the diverting opening is integrated into an intercepting gantry.

It can be favourable for assembly if the flush-in device is constructed as multi-part, especially of a lower portion and at least one upper portion which can be inserted therein. The various portions again form sealing zones, for example, at their contact areas, which can be protected from leakage by the annular channel. The connection between the individual parts of the flush-in device is usually made by a plug connection but can also be held together in any different manner, e.g. by slipping on, locating, gluing or welding.

If the flush-in device has a multi-part structure, it is advantageous if the annular channel is integrated into the lower portion of the flush-in device. This is because, for example, if the annular channel has an external lateral position, any leakage of the (inner) sealing zones of the individual shell portions can be intercepted by the externally adjacent annular channel. It is favourable if this takes place by a flow of liquid from the annular channel into the lower portion, e.g. through a bore hole between annular channel and lower portion.

If the flush-in device has a multi-part structure, it is furthermore advantageous if at least one water connection is integrated into the upper portion of the flush-in device.

The objects are also solved by a flush-in device comprising a flush-in device according to the invention and at least one cover screen placed on the upwardly open side of the flush-in device.

Also according to the invention is a washing machine, especially a washing machine with a flush-in device accessible from the top comprising a flush-in device according to the invention.

In the following exemplary embodiments the flush-in device is shown schematically in further detail with reference to the drawings and described. In the drawings FIG. 1 is a perspective view of a drum washing machine which is loaded from the top ("top loader") with the cover open, FIG. 2 is an oblique view of an embodiment of a flush-in device and FIG. 3 is a side sectional view of a further embodiment of a flush-in device together with cover screen.

FIG. 1 shows a schematic oblique view of a top loading washing machine W comprising a flush-in device 1 covered with a cover screen 4. For a user the flush-in device 1 or its flushable chamber is accessible from above for filling, e.g. by detergents. Typically, a substance, e.g. a detergent in the form of powder or granules or also as a viscous liquid, can be stored in the chambers until the chamber is flushed with water and the water-detergent mixture is typically flushed into the washing drum. Among other things, the cover screen 4 reduces the contamination of the non-accessible parts of the washing machine W and at the same time, as a result of the seal to the flush-in device 1 any leakage of water flushed into the flushable chamber into the interior of the washing machine W or out therefrom is reduced or prevented.

Figure 2:
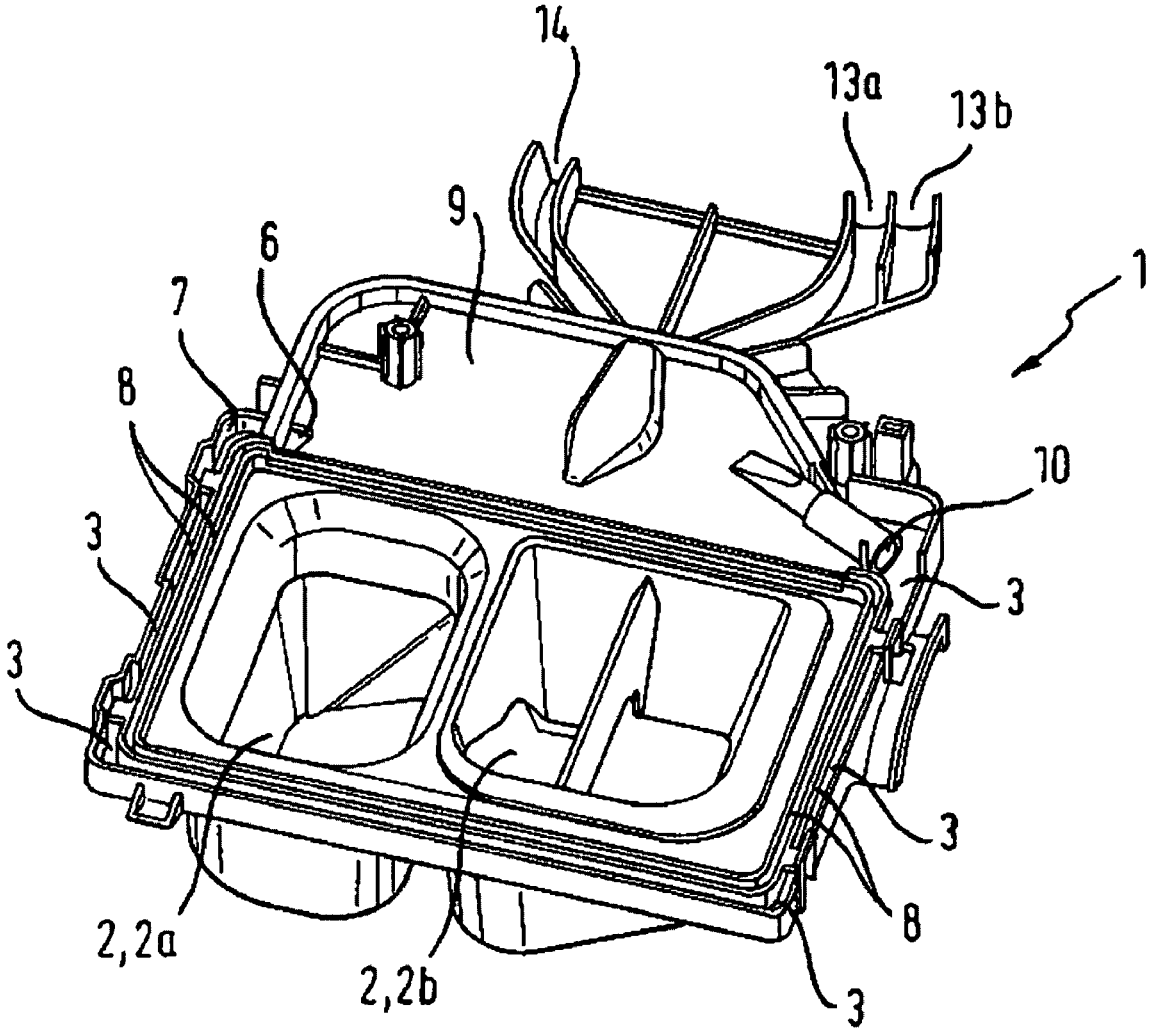
Figure 3:
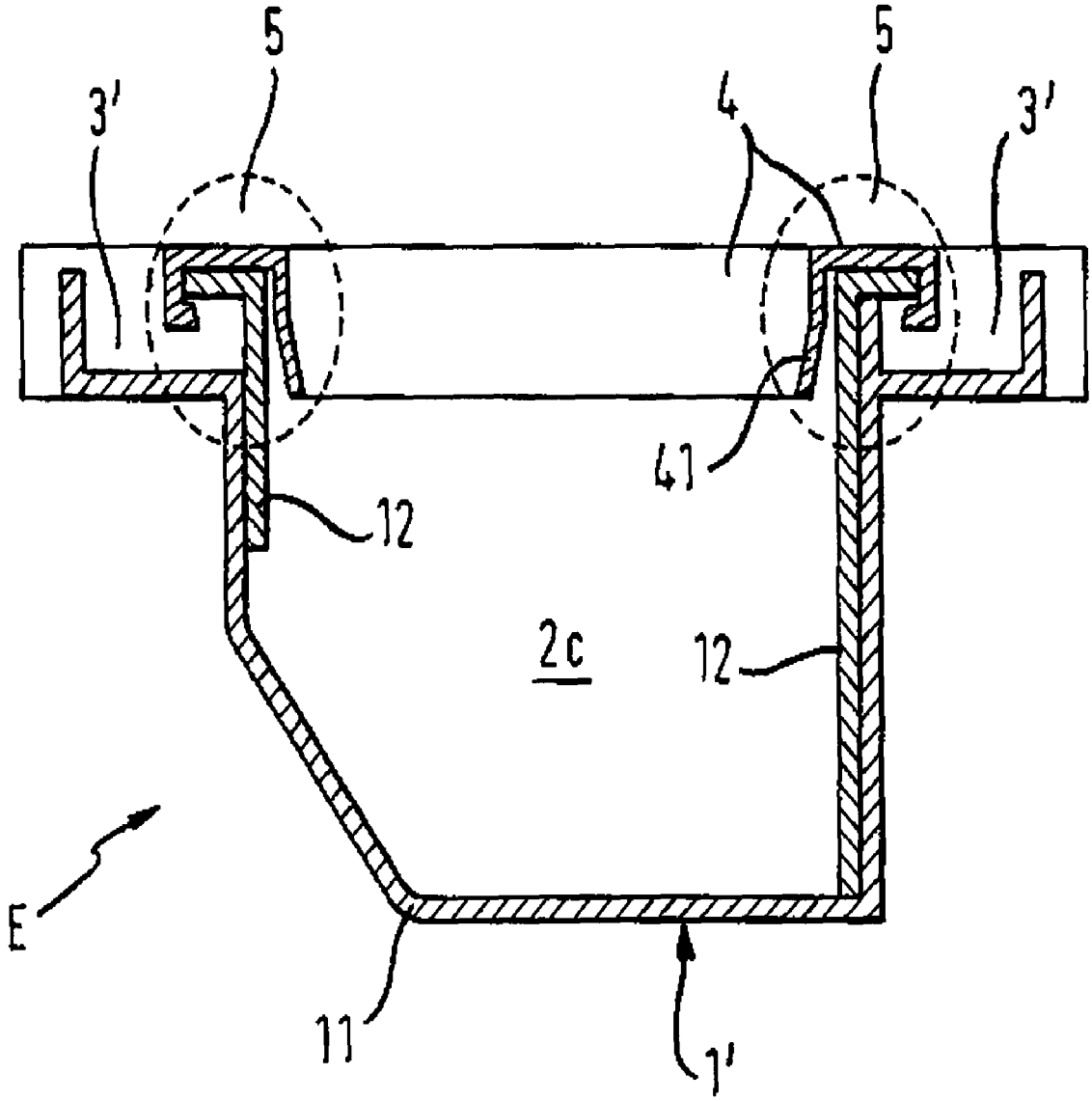

FIG. 2 shows an oblique view from above of a flush-in device 1 with the cover screen removed.

The flush-in device 1 has a first flushable chamber 2*a* open at the top and a second flushable chamber 2*b* open at the top which is divided. The chambers 2*a*, 2*b* are prepared so that they are defined as an insert in a lower shell of the flush-in device 1. The flush-in device 1 is partly surrounded by an annular channel 3. The flush-in device 1 in this case comprises two holders 13*a*, 13*b* for hot or cold water feed hoses for flushing the chambers 2*a*, 2*b* and a holder 14 for a discharge hose leading to the washing drum. Integrated in one holder face 9 is a connection 10 for a channel which branches off from one of the water supply devices which, for example, can convey clean water to the drum, for example especially for flushing the transparent drum door.

In this exemplary embodiment the annular channel 3 is interrupted by the holder face 9. Provided at one end of the annular channel 3 is a diverting opening for leakage water, not visible here. An intercepting gantry 7 is located in the area of the diverting opening. Water located on the holder face 9 can be guided through a porthole 6 into the annular channel 3.

Located between the annular channel 3 and the flushable chambers 2*a*, 2*b* is a projecting edge 8 which forms a sealing zone or a seal together with a cover plate, not shown here. The seal need not be hermetic since any leakage penetrating from one of the chambers 2*a*, 2*b* in the direction of the annular channel 3 through the seal or the sealing zone 5 is intercepted by the annular channel 3 and is guided via the diverting opening into the first flushable chamber, here, 2*a*.

During operation the flush-in device 1 is covered by the cover screen 4, not shown in this figure, apart from a portion of the chambers 2*a*, 2*b*. An operator can pour detergent, for example, into the chambers 2*a*, 2*b* from above. During the washing process one or both of the chambers 2*a*, 2*b* is flushed with water by means of a water intake so that the detergent mixes with the water and is then passed into the washing drum via a detergent outflow, not shown here. For thorough flushing of the chambers 2*a*, 2*b* the water is guided through the entire chamber as far as possible, that is also through its upper area. A powerful water flow through the chambers 2*a*, 2*b* is ensured by using conventional means such as controlling the water pressure, guiding the water jet and/or the shape of the cover screen e.g. with an overhanging skirt which projects into the chambers 2*a*, 2*b*. However, the water or the water-detergent mixture frequently penetrates under the cover screen 4 as far as the sealing zone 5. There significant quantities water should reliably be prevented from reaching the outer area of the flush-in device and therefore entering into the interior of the washing machine W. In this exemplary embodiment this is prevented by water passing through the sealing zone being intercepted in the annular channel 3 and led away again. In addition, the flush-in device 1 shown here has the advantage that any water of condensation is collected in the cover screen 4 and can drip into the annular channel 3.

In other exemplary embodiments the annular channel can naturally also be designed as continuously circumferential or can only partly follow the profile of the sealing zone, e.g. by the annular channel running only partly on the side of the sealing zone facing away from the flushable chamber.

FIG. 3 shows a schematic side sectional view along the axis of sight III-III shown in FIG. 1 of a flush-in device (E) composed of a further flush-in device 1' and a cover screen 4.

In this exemplary embodiment the flush-in device 1' is constructed as multi-part, i.e. comprising a lower portion 11 and an upper portion 12. Naturally the flush-in device 1' can also comprise further portions. The lower shell 11 now has a circumferential annular channel 3' located on a side facing away from the flushable chamber 2*c*. The upper portion 12 is inserted in the lower portion 11. Lower portion 11 and upper portion 12 can be arbitrarily fixed together, e.g. by locating by means of locating hooks, gluing, welding and so forth.

A cover screen 4 is placed on the upwardly open side of the flush-in device 1'. Among other things, the cover screen has inwardly curved overhanging skirts 41 on the side facing the flushable chamber 2*c* which prevent any escape of water through the upper opening of the chamber 2*c*. The connection between flush-in device 1' and cover screen can be made, for example, by locating according to the principle shown in FIG. 3 of DE 31 36 768 A1. Locating has the advantage that the cover screen 4 can be arranged as removable for cleaning.

After the cover screen 4 has been put in place, a sealing zone 5 is produced which is at least partly sealed against liquid flushed upwards onto the walls from the chamber 2*c*. Nevertheless, if liquid should enter through the intermediate spaces between cover screen 4 and flush-in device 1, this is intercepted in the annular channel 3'.

The annular channel 3' is connected to the lower portion 11 for liquid to pass through, not shown here and a water inlet is integrated in the upper portion 12.

In other embodiments intermediate spaces can also be formed between the individual portions of the flush-in device through which leakage liquid passes outwards and then into the annular channel.

The shape of the sealing zone 5 and the cover screen 4 can also be adapted to the design conditions, as is shown in FIG. 3 of DE 31 36 768 A1, for example.

The invention claimed is:

1. A flush-in device for flushing detergent into a washing machine, the flush-in device comprising:

a flushable chamber having walls and having a top side with an upper opening;

at least one annular channel at least partially surrounding the flushable chamber, the walls of the flushable chamber delimiting a chamber volume, the upper opening on the top side of the flushable chamber and the chamber volume being located relative to one another to delimit a liquid entry path into the chamber volume along which liquid flows that is introduced via the upper opening on the top side of the flushable chamber and that thereafter enters into the chamber volume;

a cover screen disposed directly on the top side of the flushable chamber of the flush-in device without a sealing element; and a sealing zone formed between the top side of the flushable chamber of the flush-in device and the cover screen and at least partly circumferentially surrounding the flushable chamber, the annular channel being located at least partly on the side of the sealing zone facing away from the flushable chamber, the sealing zone being located between the annular channel and the flushable chamber, wherein the cover screen includes an inwardly curved overhanging skirt on a side facing the flushable chamber, the inwardly curved overhanging skirt projecting from the upper opening on the top side of the flushable chamber into the chamber volume of the flushable chamber, and wherein the inwardly curved overhanging skirt is curved with respect to the walls of the flushable chamber, the inwardly curved overhanging skirt of the cover screen leading one of leakage liquid and condensation from the flushable chamber into the sealing zone between the top side of the flushable chamber of the flush-in device and the cover screen and toward the annular channel, the cover screen preventing the liquid from exiting the flushable chamber through the liquid entry path, and wherein the annular channel has at least one diverting opening to the flushable chamber directing liquid retained within the annular channel into the flushable chamber.

2. The flush-in device according to claim 1, wherein the diverting opening is integrated into an intercepting gantry.

3. The flush-in device according to claim 1, wherein the flush-in device comprises a multi-part structure including a lower portion and at least one upper portion inserted within the lower portion.

4. The flush-in device according to claim 3, wherein the annular channel is integrated into the lower portion of the flush-in device.

5. The flush-in device according to claim 3, further comprising at least one water connection integrated into the upper portion of the flush-in device.

6. The flush-in device according to claim 3, wherein the cover screen is connected directly to the upper portion of the flush-in device.

7. A washing machine comprising:

a housing having an interior receiving laundry;

a flush-in device comprising:

a flushable chamber having walls and having a top side with an upper opening and retaining detergent to be introduced into the interior of the housing;

at least one annular channel at least partially surrounding the flushable chamber, the walls of the flushable chamber delimiting a chamber volume, the upper opening on the top side of the flushable chamber and the chamber volume being located relative to one another to delimit a liquid entry path into the chamber volume along which liquid flows that is introduced via the upper opening on the top side of the flushable channel and that thereafter enters into the chamber volume;

a cover screen disposed directly on the top side of the flushable chamber of the flush-in device without a sealing element; and a sealing zone formed between the top side of the flushable chamber of the flush-in device and the cover screen and at least partly circumferentially surrounding the flushable chamber, the annular channel being located at least partly on the side of the sealing zone facing away from the flushable chamber, the sealing zone being located between the annular channel and the flushable chamber, wherein the cover screen includes an inwardly curved overhanging skirt on a side facing the flushable chamber, the inwardly curved overhanging skirt projecting from the upper opening on the top side of the flushable chamber into the chamber volume of the flushable chamber, and wherein the inwardly curved overhanging skirt is curved with respect to the walls of the flushable chamber, the inwardly curved overhanging skirt of the cover screen leading one of leakage liquid and condensation from the flushable chamber into the sealing zone between the top side of the flushable chamber of the flush-in device and the cover screen and toward the annular channel, the cover screen preventing the leakage liquid from exiting the flushable chamber through the liquid entry path, and wherein the annular channel has at least one diverting opening to the flushable chamber directing liquid retained within the annular channel into the flushable chamber.

8. The flush-in device according to claim 7, wherein the flush-in device comprises a multi-part structure including a lower portion and at least one upper portion inserted within the lower portion.

9. The flush-in device according to claim 8, wherein the annular channel is integrated into the lower portion of the flush-in device.

10. The flush-in device according to claim 8, further comprising at least one water connection integrated into the upper portion of the flush-in device.

11. A washing machine comprising:

a housing;

a drum disposed within the tub housing, the drum receiving laundry to be cleaned;

a flushable chamber having walls and having a top side with an upper opening and retaining detergent;

the upper opening forming a water connection for providing water into the flushable chamber, the water and detergent exiting the flushable chamber through a detergent outflow; and at least one annular channel at least partially surrounding the flushable chamber for collecting liquid that escapes from the flushable chamber, the walls of the flushable chamber delimiting a chamber volume, the upper opening on the top side of the flushable chamber and the chamber volume being located relative to one another to delimit a liquid entry path into the chamber volume along which liquid flows that is introduced via the upper opening on the top side of the flushable chamber and that thereafter enters into the chamber volume; and a projecting edge at least partially surrounding the flushable chamber and extending upwardly from the flushable chamber; and a cover screen directly coupled to the projecting edge without a sealing element and forming a sealing zone between the cover screen and the projecting edge, the sealing zone being disposed between the flushable chamber and the annular channel, wherein the cover screen includes an inwardly curved overhanging skirt on a side facing the flushable chamber, the inwardly curved overhanging skirt projecting from the upper opening on the top side of the flushable chamber into the chamber volume of the flushable chamber, and wherein the inwardly curved overhanging skirt is curved with respect to the walls of the flushable chamber, the inwardly curved overhanging skirt of the cover screen leading one of leakage liquid and condensation from the flushable chamber into the sealing zone between the projecting edge of the flushable chamber of the flush-in device and the cover screen and toward the annular channel, the cover screen preventing the leakage liquid from exiting the flushable chamber through the liquid entry path, and wherein the annular channel has at least one diverting opening to the flushable chamber directing liquid retained within the annular channel into the flushable chamber.

12. The flush-in device according to claim 11, wherein the flush-in device comprises a multi-part structure including a lower portion and at least one upper portion inserted within the lower portion.

13. The flush-in device according to claim 12, wherein the annular channel is integrated into the lower portion of the flush-in device.

14. The flush-in device according to claim 12, wherein the water connection is integrated into the upper portion of the flush-in device.

15. A flush-in device for flushing detergent into a washing machine, the flush-in device comprising:

a flushable chamber having walls and having a top side with an upper opening;

at least one annular channel at least partially surrounding the flushable chamber, the walls of the flushable chamber delimiting a chamber volume, the upper opening on the top side of the flushable chamber and the chamber volume being located relative to one another to delimit a liquid entry path into the chamber volume along which liquid flows that is introduced via the upper opening on the top side of the flushable chamber and that thereafter enters into the chamber volume;

a projecting edge at least partially surrounding the flushable chamber and extending upwardly from the flushable chamber;

a cover screen disposed directly on the top side of the projecting edge of the flushable chamber of the flush-in device without a sealing element, wherein the cover screen includes inwardly curved overhanging skirts on a side facing the flushable chamber that prevents the liquid from exiting through the upper opening of the flushable chamber; and a sealing zone formed between the top side of the projecting edge of the flush-in device and the cover screen and at least partly circumferentially surrounding the flushable chamber, the annular channel being located at least partly on the side of the sealing zone facing away from the flushable chamber, the sealing zone being located between the annular channel and the flushable chamber, wherein the cover screen includes an inwardly curved overhanging skirt on a side facing the flushable chamber, the inwardly curved overhanging skirt projecting from the upper opening on the top side of the flushable chamber into the chamber volume of the flushable chamber, and wherein the inwardly curved overhanging skirt is curved with respect to the walls of the flushable chamber, the inwardly curved overhanging skirt of the cover screen leading leakage liquid and condensation from the flushable chamber into the sealing zone between the top side of the projecting edge of the flushable chamber of the flush-in device and the cover screen and toward the annular channel, the cover screen preventing the leakage liquid from exiting the flushable chamber through the liquid entry path, and wherein the annular channel has at least one diverting opening to the flushable chamber directing liquid retained within the annular channel into the flushable chamber.

* * * * *